United States Patent [19]

Wheeler

[11] Patent Number: 4,999,640

[45] Date of Patent: Mar. 12, 1991

[54] AEROSTAT TETHER LIGHTING APPARATUS

[75] Inventor: Myron S. Wheeler, Columbia, Md.

[73] Assignee: Westinghouse Electric Corp., Pittsburgh, Pa.

[21] Appl. No.: 402,574

[22] Filed: Sep. 5, 1989

[51] Int. Cl.[5] ..... H01Q 1/28

[52] U.S. Cl. ..... 343/706; 343/848; 343/849; 244/115

[58] Field of Search ..... 343/706, 848, 849; 455/97; 244/1 A, 114 R, 115

[56] References Cited

U.S. PATENT DOCUMENTS 744,936 11/1903 Plecher ..... 343/706
1,296,687 3/1919 Nichols ..... 343/706
4,476,576 10/1984 Wheeler et al. ..... 343/706
4,842,221 6/1989 Beach et al. ..... 343/706

*Primary Examiner*—Rolf Hille
*Assistant Examiner*—Hoanganh Le
*Attorney, Agent, or Firm*—D. Schron

[57] ABSTRACT

Lighting devices for an aerostat tether wherein the tether is used as a communication antenna. The lighting apparatus includes a split core transformer having a plurality of turns of secondary winding with the electrical portion of the tether constituting a single turn primary. The secondary voltage is provided to a voltage limiter which reflects excess energy back into the primary circuit, with the output of the voltage limiter being fullwave rectified and regulated to a predetermined DC value for operating a strobe light.

7 Claims, 5 Drawing Sheets

AEROSTAT TETHER LIGHTING APPARATUS

BACKGROUND OF THE INVENTION

1. Field of the Invention

The invention in general relates to a tethered aerostat system, and in particular to a lighting device carried by the tether when the tether is utilized as an antenna for a transmitter.

2. Background Information

Tethered aerostats are commonly used as high altitude platforms for electronic equipment such as radar, communications, relay stations etc. The aerostat, which is an aerodynamically shaped lighter-than-air balloon is held on station and is securely connected to a ground based mooring system by means of a high-strength, light-weight electromechanical tether.

In order to make the tether visible to passing aircraft, lights such as strobe lights are placed along the tether at predetermined intervals during the deployment of the aerostat. Typically, battery operated strobe lights are limited to about 50 hours of operation after which the battery packs must be recharged. In addition, once deployed, the strobe lights cannot be turned off from the ground. Accordingly, for conventional aerostat systems a method has been proposed whereby power may be coupled to the strobe lights via transformer action utilizing a core and the electrically conducting portion of the tether as a one turn primary winding and to which is connected, at the ground mooring system, a signal generator supplying electrical power. The circuit is completed through the tether capacity to ground.

In addition to its use as a high altitude platform, the aerostat arrangement may also be used as a high power VLF communication system with the electrical portion of the tether acting as the antenna. It would be desirable to operate strobe lights on the antenna similar to those on the conventional aerostat system, however, if the VLF transmitter current is utilized to supply power to the strobe lights, the conventional circuitry for powering the strobe lights cannot handle the wide range of tether currents and frequencies as may be encountered in the VLF transmitter application.

Accordingly, it is an object of the present invention to provide for lighting apparatus for the tether of an aerostat and which will be operative when the tether is utilized as the antenna when the system is operating in a transmitter mode of operation.

SUMMARY OF THE INVENTION

The present invention relates to lighting apparatus for a system utilizing a deployed aerostat maintained at a predetermined altitude by means of an electromechanical tether and wherein the electrical portion of the tether is utilized as an antenna for a transmitter.

The apparatus includes one or more lighting devices which may be placed on the tether during deployment of the aerostat. The securing of the lighting device to the tether is by means of a clamp assembly which includes a transformer core surrounding the tether, with the electrical portion of the tether constituting a single turn primary winding. A secondary winding having a multitude of turns is wound around the transformer core and lighting circuitry connects the secondary winding to the lighting device to supply electrical power thereto.

The lighting circuitry includes a voltage limiter circuit connected to the secondary winding and operable to limit the secondary voltage to predetermined positive and negative values and additionally to provide an impedance mismatch to reflect excess power back into the primary winding. Rectifier means connected to the voltage limiter supplies a unidirectional voltage and a voltage regulator means is operable to receive the unidirectional voltage and supply the lighting device with a regulated operating voltage to light the lighting device. The assembly is completed by means of a corona shield which is connected to the clamp assembly to prevent destructive corona at any sharp corners of the apparatus.

BRIEF DESCRIPTION OF THE PREFERRED EMBODIMENT

Figure 1:
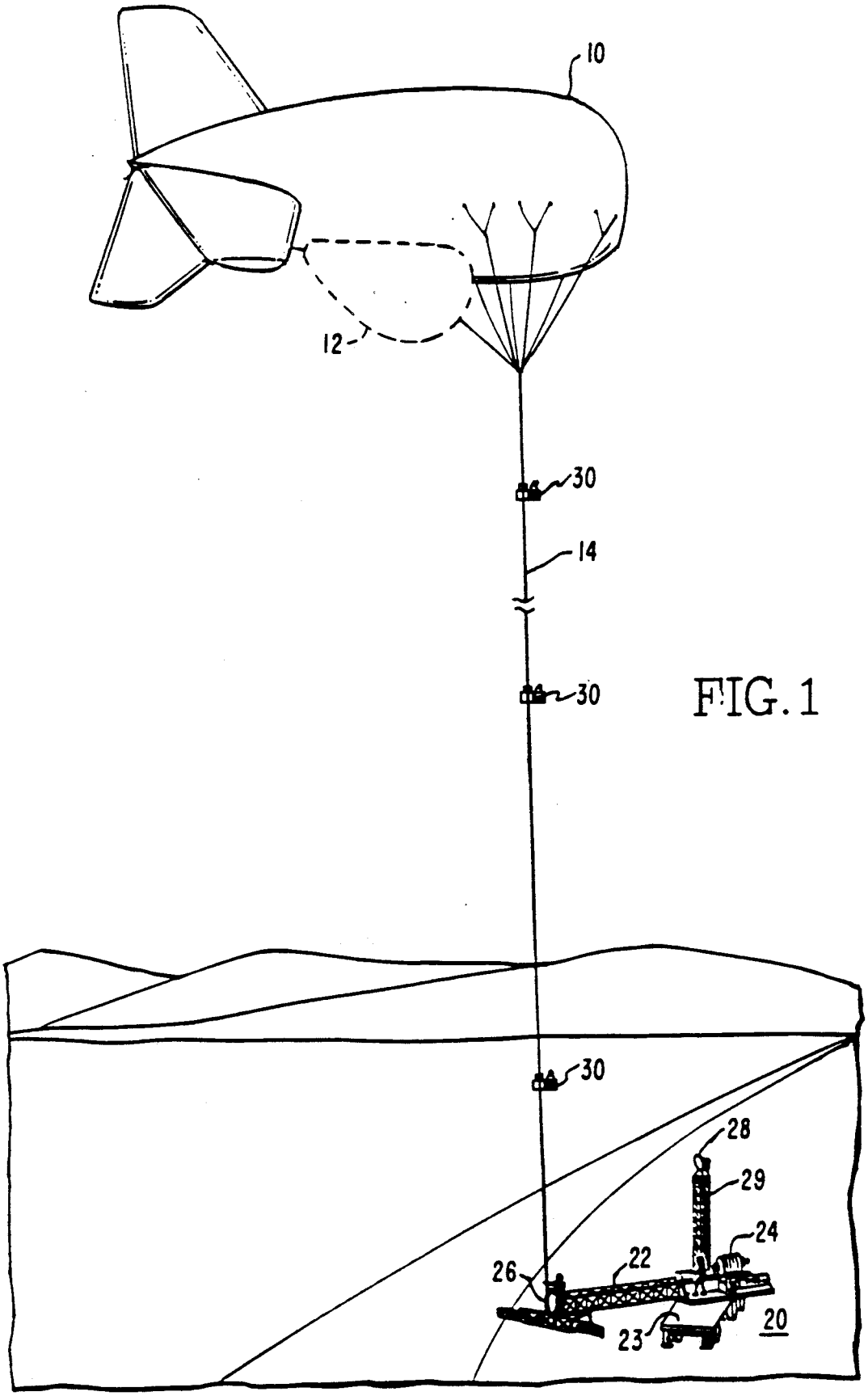
FIG. 1 is a view of an aerostat in a deployed condition connected to a ground mooring system.

A typical aerostat system is illustrated in FIG. 1 and includes an aerostat 10 which normally carries an electronic payload protected from the elements by an aerodynamically shaped windscreen 12 pressurized by air to maintain its aerodynamic shape. In FIG. 1, windscreen 12 is shown dotted in view of the fact that the aerostat 10 is not used to carry a payload but is only used to support the electromechanical cable 14 which will function as the radiating antenna in a high power VLF transmission system.

The electromechanical tether is connected to a ground based aerostat deployment/retrieval mooring system 20 which by way of example includes an elongated boom 22 which is rotatable about a base structure 23 and which carries a main winch 24 upon which the tether 14 is wound. The tether passes from the winch 24 through the boom 22 and around a grooved pulley 26 generally known as a flying sheave, located at the end of the boom and rotatable about the boom axis so that the sheave 26 and tether 14 are always in the same plane. When on the ground, the aerostat 10 is attached to the mooring system 20 through mooring lines (not illustrated) and a nose cone on the aerostat mates with a nose latch assembly 28 at the top of tower 29, also carried by boom 22.

In order to warn aircraft which may be flying in the vicinity of the aerostat, visibility enhancement devices may be placed on the tether 14. Several of these devices 30 are illustrated in FIG. 1 and by way of example, may be strobe lights. One type of strobe light arrangement which clamps to the tether is illustrated in U.S. Pat. No. 4,842,219 hereby incorporated by reference. The strobe light illustrated by way of example in that patent is battery operated and requires battery charging after approximately 50 hours of use. One type of tether which is used in many aerostat applications is illustrated in U.S. Pat. No. 4,842,221 also hereby incorporated by reference. Basically, the electromechanical tether would include a central core having a plurality of electrical power conductors for providing power to any equipment carried by the aerostat, with the central core being surrounded by a non-metallic central strength member such as a plurality of layers of synthetic fibers. The arrangement is surrounded by a plastic wrap forming a weather barrier which in turn is surrounded by a woven metallic braiding. A flexible outer protective jacket completes the tether construction with the jacket generally being made of a partially conducting material in order to handle relatively small current flow into the metallic braid due to atmospherically induced currents.

Since the tether architecture must be continuous and unbroken, it is not possible to tap into any central power conductors in order to light the strobe lights in place of batteries. Accordingly, an inductive coupling system has been utilized, one example of which is illustrated in FIG. 2.

Figure 2:
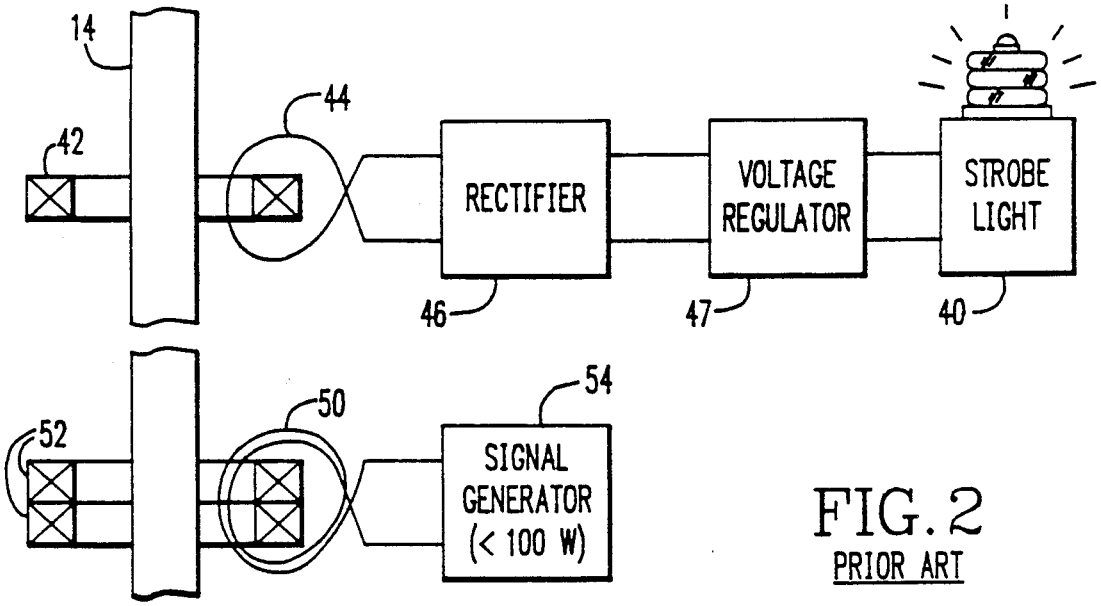
FIG. 2 PRIOR ART
FIG. 2 illustrates a prior art low power lighting arrangement.

In FIG. 2, a strobe light 40 is inductively coupled to the tether 14 by an arrangement which includes a ferrite transformer core 42 around the tether 14 which couples energy from the single turn primary (the tether 14) to a one or two turn secondary winding 44. The transformer core 42 is a split core arrangement carried by a clamping device such as described in the aforementioned U.S. Pat. No. 4,842,219. The AC voltage is rectified by means of a rectifier 46, the output of which is regulated by voltage regulator 47 to provide a constant regulated three volt DC output to replace the batteries normally used on the strobe 40.

Figure 2A:
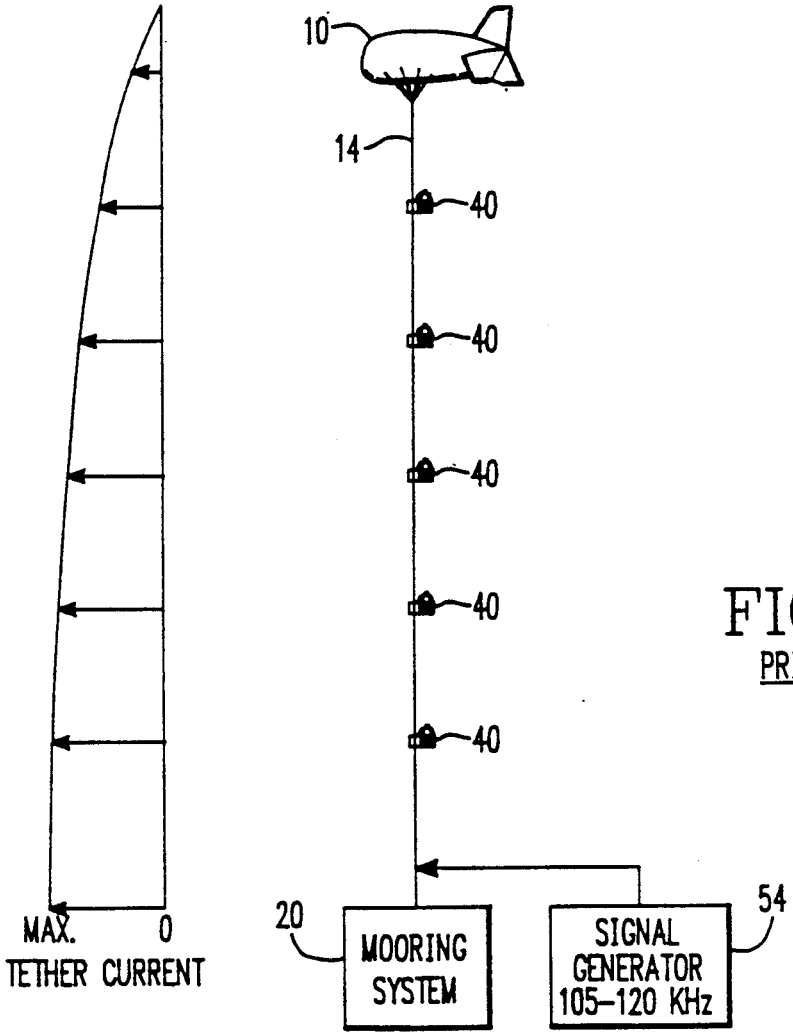
FIG. 2A PRIOR ART
FIGS. 2A and 2B illustrate a current distribution along the tether utilizing two different frequency ranges of the signal generator power supply.

Power for transmission up the cable to light the strobe light is supplied by a power source in the form of a low power signal generator 54, the output of which is connected to a multi-turn primary winding 50 wound around one or more ferrite transformer cores 52, with the tether 14 constituting a single turn secondary. The signal generated power is equivalent to approximately a 100 watt light bulb or less and FIG. 2A shows an arrangement wherein the signal generator can supply a signal in a first predetermined frequency range, for example, from 105 to 120 kilohertz. The transformer coupling induces radio frequency currents on the conductors of the tether but principally on the outer braid because of skin effect.

The apparatus of FIG. 2 is shown with the tether and aerostat in FIG. 2A, wherein the driving frequency is such that the tether length is approximately ¼ wave length for the operating frequency and energy is taken from the tether at each location of the strobe light 40 by the apparatus illustrated in detail in FIG. 2. To the left of the tether in FIG. 2A, there is illustrated a current distribution curve of tether current and it is seen that the tether current is a maximum at the ground location and progressively decreases at each strobe light location. The aerostat 10 provides some top loading and accordingly the tether is somewhat less than ¼ wavelength such that some small value of tether current is dispersed in the aerostat proper.

Figure 2B:
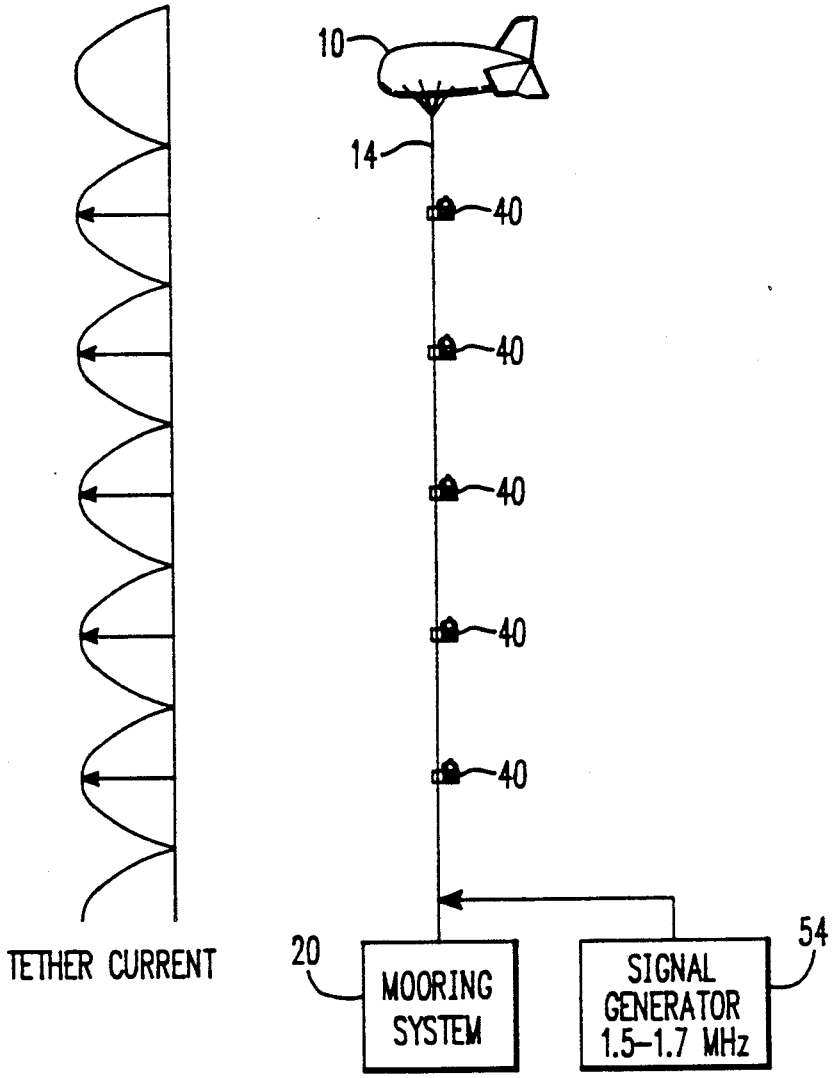
FIG. 2B PRIOR ART

In FIG. 2B there is illustrated an arrangement wherein the low power signal generator 54 provides an output signal in the megahertz region. In such instance, as seen to the left of the tether 14, the tether current distribution is a series of current peaks which occur at predetermined spacings and at which spacings would be located the strobe lights 40 such that each strobe light experiences approximately the same current value making the inclusion of a voltage regulator less critical.

Figure 3:
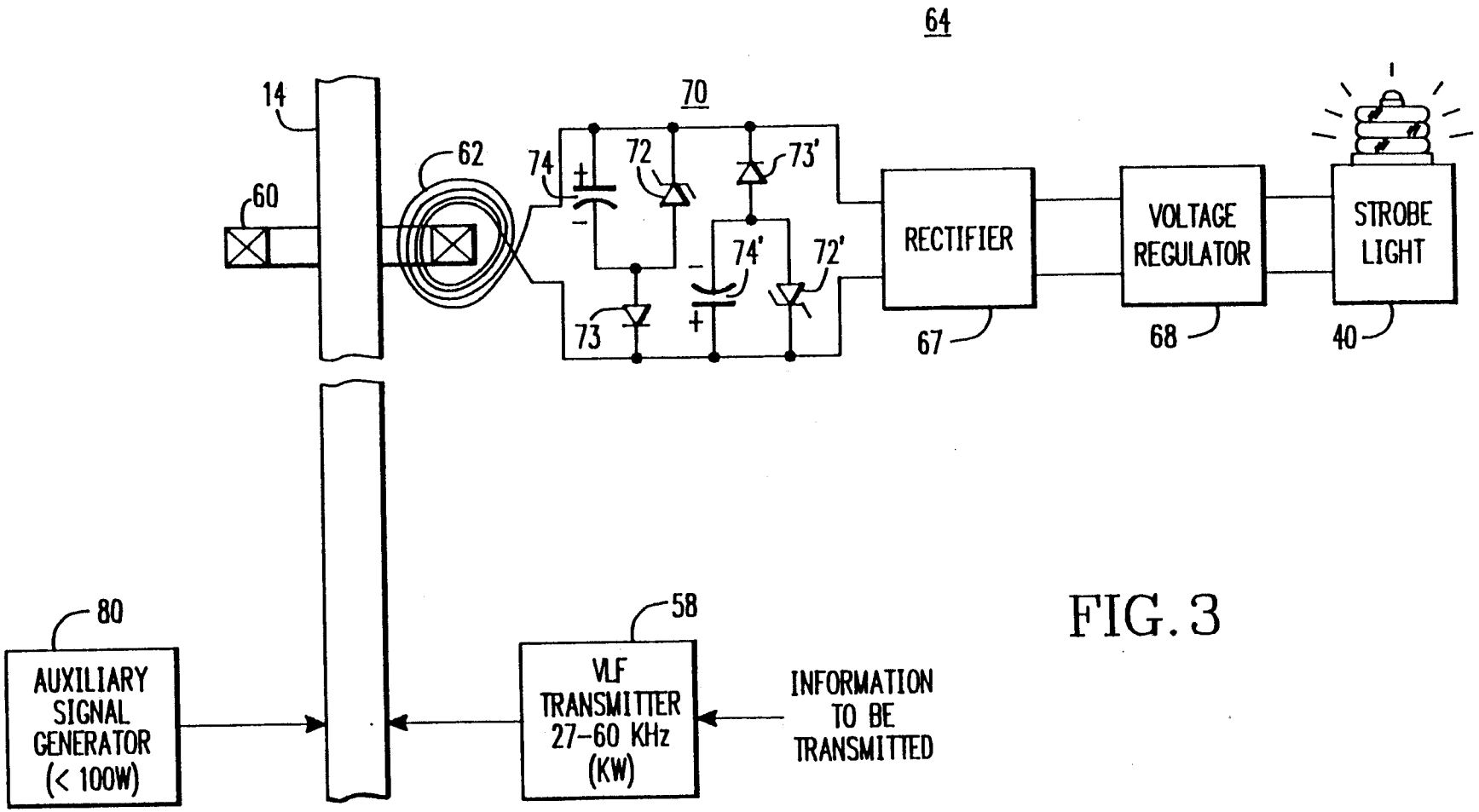
FIG. 3 illustrates one embodiment of the present invention.

Operation of the strobe lights with the previously described apparatus is entirely satisfactory since the dedicated signal generator provides a power of 100 watts or less. When, however, the tether is used as an antenna for example in a VLF communication systems, the VLF transmitter operating over a frequency range, for example of 27 to 60 kilohertz puts out a power in the thousands of watts range, typically approaching 25 kilowatts. FIG. 3 illustrates one embodiment of the present invention which will allow strobe light operation at this increased power level without burning out the lighting circuitry necessary for conditioning the strobe light voltage.

In FIG. 3, multi-kilowatt VLF transmitter 58 is operable in conjunction with tether 14 functioning as an antenna, to transmit an information signal. A plurality of strobe lights may be placed on the tether, with FIG. 3 illustrating one such arrangement.

Tether 14 operates as a single term primary of a transformer having a ferrite core 60 with a secondary winding 62 being constituted by a multitude of turns such that the primary to secondary ratio may be 1:40 by way of example. Lighting circuitry 64 connects the secondary winding 62 to strobe light 40, with the lighting circuitry 64 including a full wave rectifier 67 and voltage regulator 68, as previously described. In the embodiment of FIG. 3, strobe light 40 must be able to operate over an extremely wide range of tether currents and frequencies as may be encountered in the VLF transmitter application. In such case, a voltage regulator, in conjunction with a rectifier such as described in FIG. 2, cannot cover the wide range and will overheat or burn out at one extreme or drop out of regulation at the other extreme.

The arrangement of FIG. 3 includes in the lighting circuitry 64 a voltage limiter 70 which functions not only to limit positive and negative excursions of the voltage on secondary 62, but also functions to provide an impedance mismatch such that when the limiter conducts it causes a reflection of the energy back into the primary circuit and keeps excessive power from entering the lighting circuitry.

In one arm, the voltage limiter 70 includes a zener diode 72 along with conventional diode 73 for limiting positive excursions of the voltage waveform appearing at the secondary winding 62. The capacitor 74 is placed in parallel with the zener diode so as to maintain the threshold voltage of the zener diode 72 thereacross. In a similar fashion, another arm of voltage limiter 70 includes zener diode 72' in conjunction with conventional diode 73' for limiting negative excursions of the signal appearing on secondary winding 62. The capacitor 74' maintains the threshold voltage on zener diode 72'.

Figure 4:
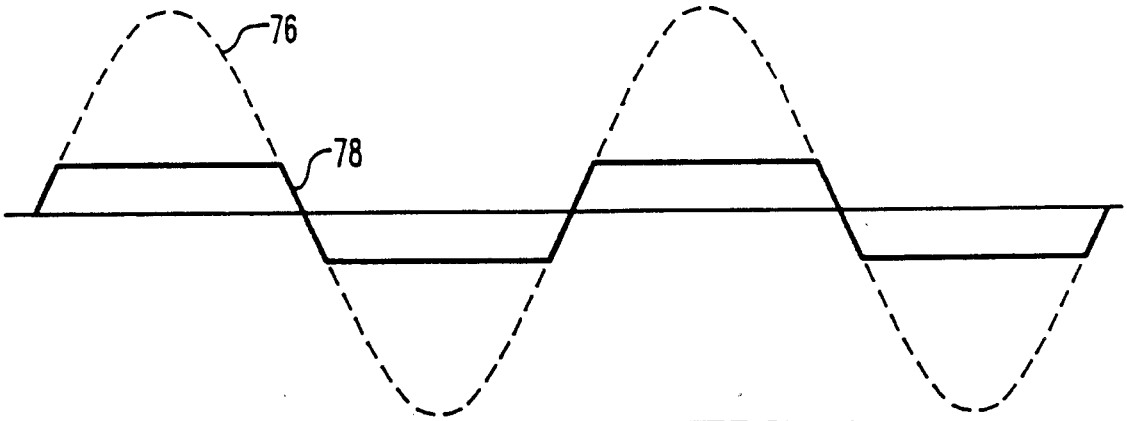
FIG. 4 illustrates a waveform associated with the voltage limiter of FIG. 3.

With additional reference to FIG. 4, dotted waveform 76 represents the secondary voltage appearing at the primary winding 62 while the solid waveform 78 represents the idealized positive and negative limiting action of the voltage limiter 70, such waveform being provided to the full wave voltage rectifier 67. The rectified voltage is provided to the strobe light 40 as a constant voltage after regulation by voltage regulator 68.

Referring once again to FIG. 3, if the requirement exists for the strobe light to be on while the transmitter 58 is inoperative, an auxiliary low power signal generator 80 may be provided. This signal generator would be similar to that utilized in the conventional transmitter arrangement, as illustrated in FIG. 2. The auxiliary low power source may now require a little more power for strobe light operation than that of FIG. 2A which was optimized for minimum power operation. By way of example, 200W may now be required.

Figure 5:
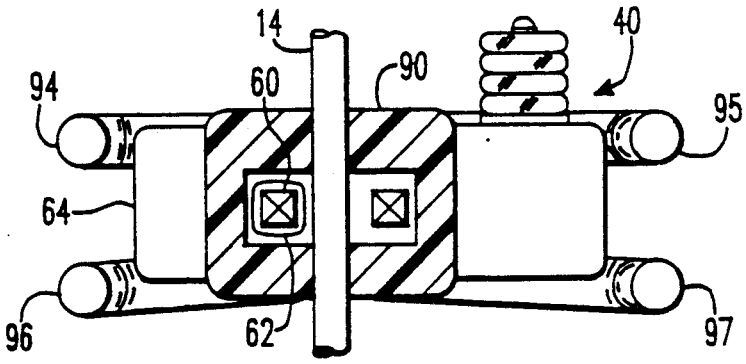
FIGS. 5 and 6 are views of a corona protection arrangement for the lighting device.
Figure 6:
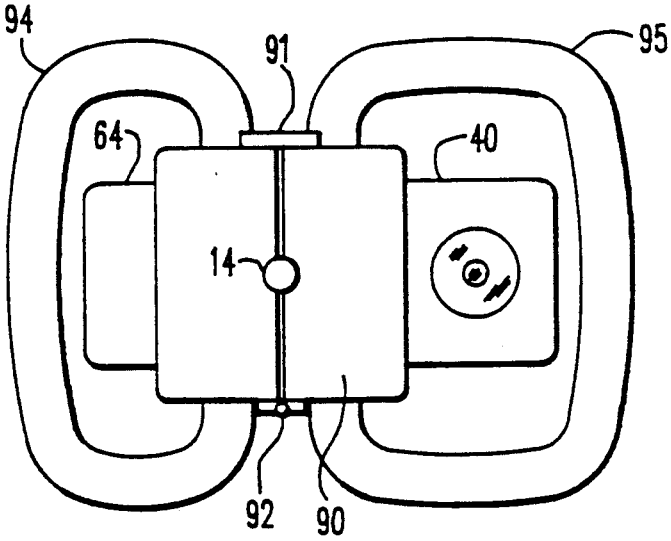

With the high power operation described, the apparatus must be designed to prevent destructive corona. Apparatus to accomplish this objective is illustrated in side view in FIG. 5 and plan view in FIG. 6. The arrangement includes a clamp assembly 90 (shown in cross section in FIG. 5) which includes a latch 91 and hinge 92 (FIG. 6) for clamping around tether 14. The clamp assembly includes the ferrite core 60 and secondary winding 62, with the lighting circuitry 64 being encased, and connected to the left-hand side of the clamp assembly 90. As illustrated, the strobe light 40 may be attached to the right-hand side of clamp assembly 90. In order to prevent corona, a corona shield is provided and includes metallic tubing such as aluminum tubing 94, 95, 96 and 97 connected by way of example to the clamping assembly 90 and forming a cage around the strobe .light and associated electrical circuitry.

I claim:

1. Lighting apparatus for a system utilizing a deployed aerostat maintained at a predetermined altitude by means of an electromechanical tether and wherein the electrical portion of said tether is utilized as an antenna for a transmitter, comprising:

(a) at least one clamp assembly including means for clamping around said tether at a predetermined position thereon;

(b) said clamp assembly further including a transformer core surrounding said tether, with said electrical portion of said tether constituting a single turn primary winding;

(c) a secondary winding having a plurality of turns wound around said transformer core and generating a secondary voltage;

(d) light means attached to said clamp assembly;

(e) lighting circuitry connecting said secondary winding with said light means for supplying electrical power to said light means;

(f) said lighting circuitry including a voltage limiter circuit connected to said secondary winding and operable to limit the secondary voltage generated by the secondary winding to predetermined positive and negative values and to reflect excess power back into said primary winding;

(g) rectifier means connected to said voltage limiter for supplying a unidirectional voltage;

(h) voltage regulator means connected to said rectifier means and being operable to receive said unidirectional voltage and supply said lighting device with a regulated voltage to operate said light means; and (i) corona shield means connected to said clamp assembly for protecting said light means and said lighting circuitry.

2. Apparatus according to claim 1 which additional includes:

(a) an auxiliary, low power source coupled to said tether for providing power to said tether to light said light means when said transmitter is not operating.

3. Apparatus according to claim 1 wherein:

(a) said means for clamping includes first and second portions hinged together for placement around, and for frictional engagement with said tether;

(b) said transformer core comprises a split core including two core halves, and one core half being carried in said first portion of said clamping means and the other core half being carried in said second portion of said clamping means.

4. Apparatus according to claim 1 wherein:

(a) said secondary includes at least 10 turns.

5. Apparatus according to claim 1 and additionally including:

a transmitter providing multiple thousands of watts of power to said tether when transmitting.

6. Apparatus according to claim 1 wherein:

(a) said corona shield means includes a plurality of metal tubes attached to said clamp assembly.

7. Apparatus according to claim 6 wherein:

(a) said means for clamping includes first and second portions hinged together for placement around and for frictional engagement with said tether; and (b) said corona shield means includes at least one of said metal tubes around said first portion and another metal tube around said second portion of said means for clamping.

* * * * *